United States Patent [19]

Hattori

[11] 4,456,385

[45] Jun. 26, 1984

[54] INTERPOLATING TIME SET APPARATUS

[75] Inventor: Motoichi Hattori, Fujisawa, Japan

[73] Assignee: Tokyo Shibaura Denki Kabushiki Kaisha, Kanagawa, Japan

[21] Appl. No.: 444,335

[22] Filed: Nov. 24, 1982

[30] Foreign Application Priority Data

Nov. 30, 1981 [JP] Japan ..... 56-192265

[51] Int. Cl.[3] ..... G04B 17/12; G04B 27/00

[52] U.S. Cl. ..... 368/187; 368/185

[58] Field of Search ..... 368/185, 187, 188

[56] References Cited

U.S. PATENT DOCUMENTS

| | | | |
|---|---|---|---|
| Re. 31,225 | 5/1983 | Willis et al. | 368/188 |
| 3,762,152 | 10/1973 | Marz | 368/188 |
| 4,004,085 | 1/1977 | Makino et al. | 340/324 AD |
| 4,068,465 | 1/1978 | Bacon | 368/188 |

FOREIGN PATENT DOCUMENTS 2042226 9/1980 United Kingdom .

2070292 9/1981 United Kingdom .

OTHER PUBLICATIONS

IEEE Transaction on Consumer Electronics, vol. 22, No. 1, (1976), "A Programmable TV Receiver", 1/76.

*Primary Examiner*—Bernard Roskoski

*Attorney, Agent, or Firm*—Cushman, Darby and Cushman

[57] ABSTRACT

A time set apparatus includes twelve hour set switch keys and twelve minute set switch keys. Each of the hour set switch keys designates one of 1 o'clock to 12 o'clock. Each of the minute set switch keys designates one of 0, 5, 10, . . . 50 and 55 minutes. The minute set switches are coupled to an interpolation circuit. The interpolation circuit counts how many times any one of the minute switch keys is depressed, and generates an interpolation data. When 10 o'clock key and 30 minute key is once depressed and then the 30 minute key is further depressed by three times, the interpolation data indicates "3" and the set time becomes "10:33".

31 Claims, 17 Drawing Figures

INTERPOLATING TIME SET APPARATUS

BACKGROUND OF THE INVENTION

1. Field of the Invention

This invention relates to a time set apparatus for an electronic clock, particularly to an improvement of a time set part of a digital clock which is widely adapted for a purpose of, e.g., a timer of audio equipment, VTR, TV and the like.

2. Prior Art of the Invention

An electronic digital clock having a function of timer, alarm, etc. is now widely marketed. Moreover it is often combined with home use electrical manufactures such as radio receivers, audio components, VTR or TV, or any other industrial instruments.

In such electronic digital clock the present actual time is displayed at a display window, whereas a set time for alarm or timer is displayed at the actual time display window or at some other display provided only for the set time.

A correction on the displayed actual time or on the set time is carried out by means of a switch which is used both for the actual time correction and the set time correction, or it is carried out by means of an actual time correction switch and a set time correction switch.

For correcting the time there are some manners in which putting forward or putting back the displayed time is made by one switch or two independent switches and in which the time correcting speed can be changed from slow to fast. In any case it is necessary to manipulate one or two switch keys (buttons) with monitoring the displayed time so as to set the clock to a desired time.

According to a prior art electronic clock, during a time correction, a person who wishes to correct or change the time has to carefully manipulate a time correction key while looking at the display to determine whether or not the time reaches the desired corrected or changed time. Especially, when the user is not yet skilled on the time change manipulation, some difficulties are imposed.

A typical prior art arrangement addressing the above problem is Japanese Patent Application Publication No. 56-35391. This publication discloses a time set apparatus comprising twelve switch keys being circularly arranged like the display board of a conventional analog type clock. In this apparatus the time set is carried out by the manipulation of twelve keys.

The operation panel for manipulating the time keys of the above prior art has a configuration similar to the configuration as shown in FIG. 1. Thus, there are provided with a display window 10 in which present actual time etc. are displayed, with an hour set key array 11 being formed of twelve switches h1 to h12, and with a minute set key array 12 being formed of twelve switches m0 to m55. The arrangement of key arrays 11 and 12 resembles the arrangement of numbers of an analog clock face.

In such prior art electronic clock arrangements the time set manipulation will be performed as follows.

Assume here that the time "10:30" is to be set in an alarm set mode or an actual time set mode. In this case the switch h10 of hour set key array 11 and the switch m30 of minute set key array 12 are depressed. Such depressing manipulation is simpler and easier than a manner in which the desired set time is reached through the manipulation of a fast time scanning or the dialing of a time scale.

Problem of the Prior Art

Although the abovementioned prior art clock can easily set the time in five minute increments by the selective manipulation of keys corresponding to the numerical display of analog clock face, it cannot set the time by one minute increments. If a time set by one minute increments is desired, according to the above prior art, sixty minute set keys are necessary, resulting in rather complicated manipulations and a high manufacturing cost.

SUMMARY OF THE INVENTION

It is accordingly the object of the present invention to provide a time set apparatus for an electronic clock which enables a user to easily set the time for timer, alarm or the like in one minute increments by a simple key manipulation.

To achieve the above object there is provided, according to the present invention, a time set apparatus of having twelve hour set keys (switches) and a plurality of (twelve) minute set keys (switches). Each of the minute set keys designates its specific time by, e.g., every five minutes and, in addition, designates the target time by every one minute by counting the number of times the minute set key is depressed. Such counting for every one minute interpolates the interval of the five-minute designation.

DETAILED DESCRIPTION OF THE PREFERRED EMBODIMENTS

Figure 1:
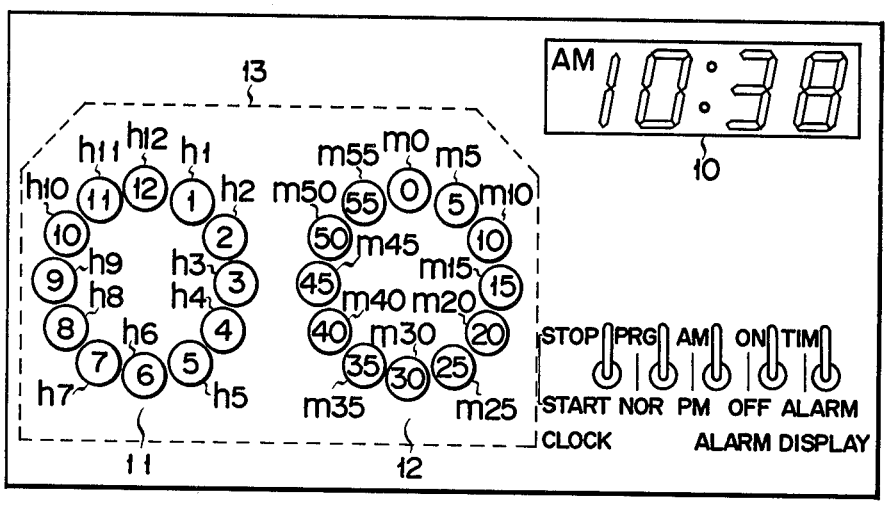
FIG. 1 shows a panel view wherein twelve hour keys and twelve minute keys are circularly laid out like an analog type clock.

A detailed description of the preferred embodiments according to the present invention is given with reference to the drawings. Note here that a common reference numeral or symbol is used to designate functionally equivalent portions throughout the drawings.

Figure 2:
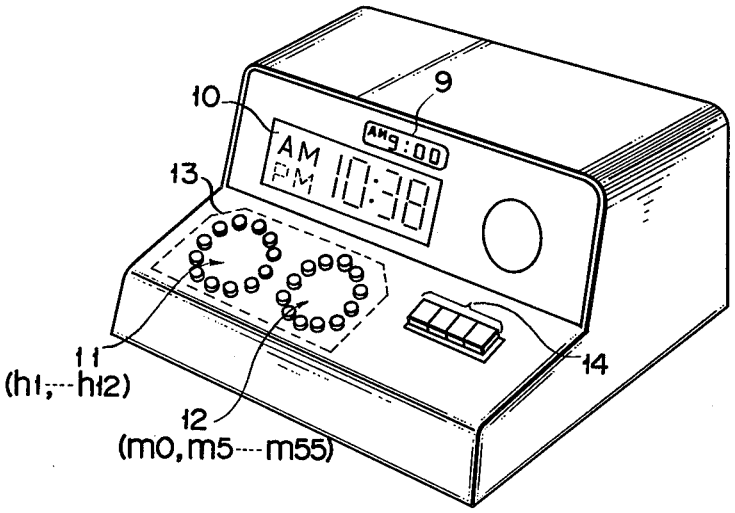
FIG. 2 shows a perspective view of an electronic clock having a time set apparatus of the invention.

FIG. 2 shows a perspective view of an electronic clock having a time set apparatus of the invention.

A set time for alarm etc. is displayed at a display window 9 and a present actual time is displayed at a display window 10. The display device used in the windows 9 and 10 may be an LED array, a fluorescent display tube, a liquid crystal display or some other type of display. A time set switch panel 13 is provided with hour set key array 11 and minute set key array 12. Array 11 is formed of twelve switches h1 to h12 whose configuration corresponds to the panel layout of 1 o'clock to 12 o'clock of an analog clock. Array 12 is formed of twelve switches m0 to m55 whose configuration resembles the arrangement of 0 minute to 55 minutes of an analog clock.

The above electronic clock is further provided with mode switches 14 for selecting specific modes of the clock as well as operational modes of an adapted device such as a radio receiver.

In such electronic clock the key manipulation for setting the alarm time or for correcting the actual time may be performed such that first, one key of switches h1–h12 is depressed to set the desired hour and then one key of switches m0–m55 is depressed to set the desired minute. For instance, when the desired time is "10:30", the 10 o'clock key of switch h10 is depressed and the 35-minute key of switch m35 is depressed. Then, the time "10:30" is set. When the desired time is "10:30", each key of the switches h10 and m35 is once depressed so that "10:35" is set. Then, the key of switch m35 is further depressed by three times in order to interpolate "3" minutes between "35" minutes and "40" minutes. The interpolated data of "3" minutes is added to "35" minutes and the set time becomes "10:38".

Figure 3A:
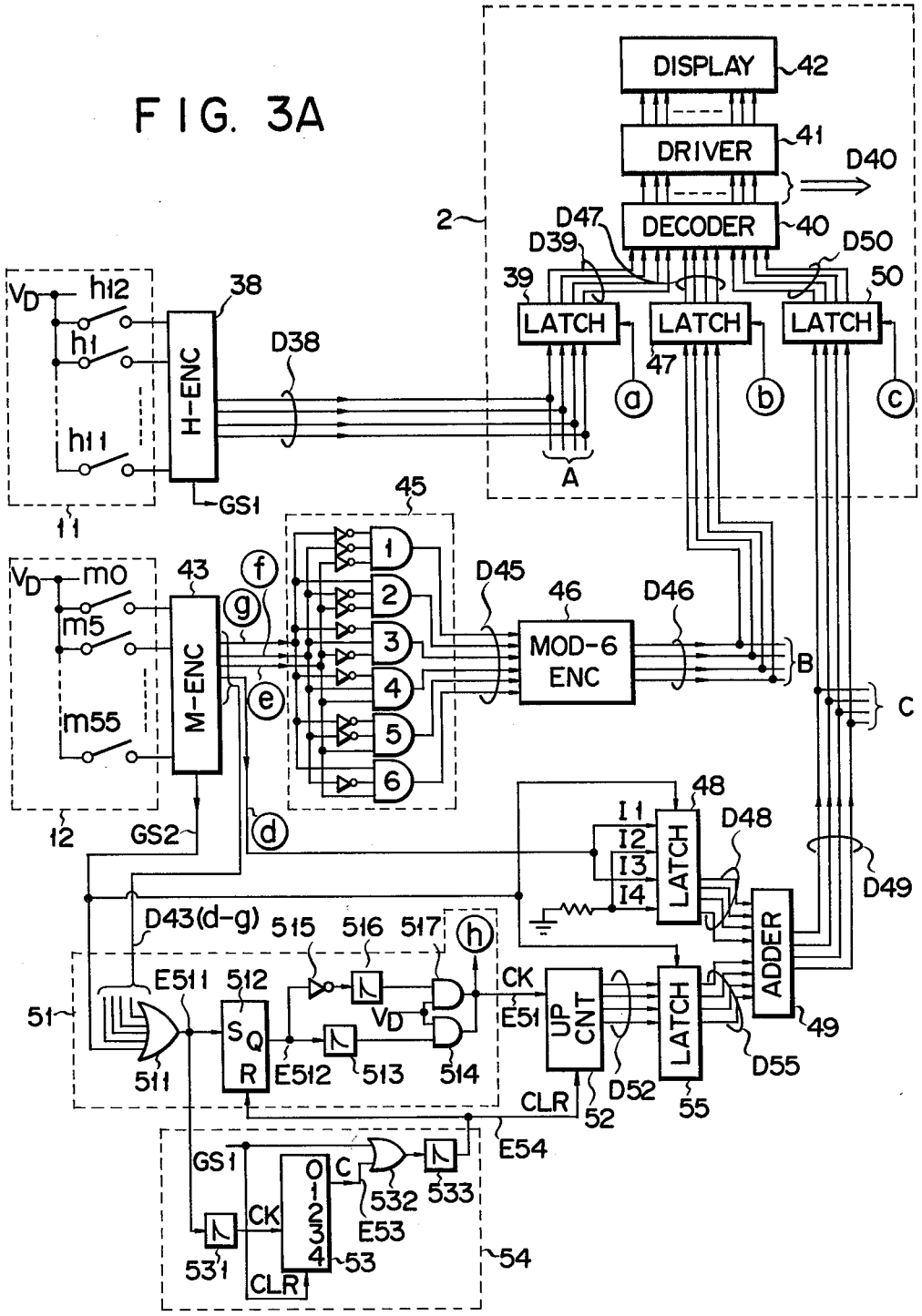
FIGS. 3A and 3B jointly show one embodiment of a time set apparatus of the invention.
Figure 3B:
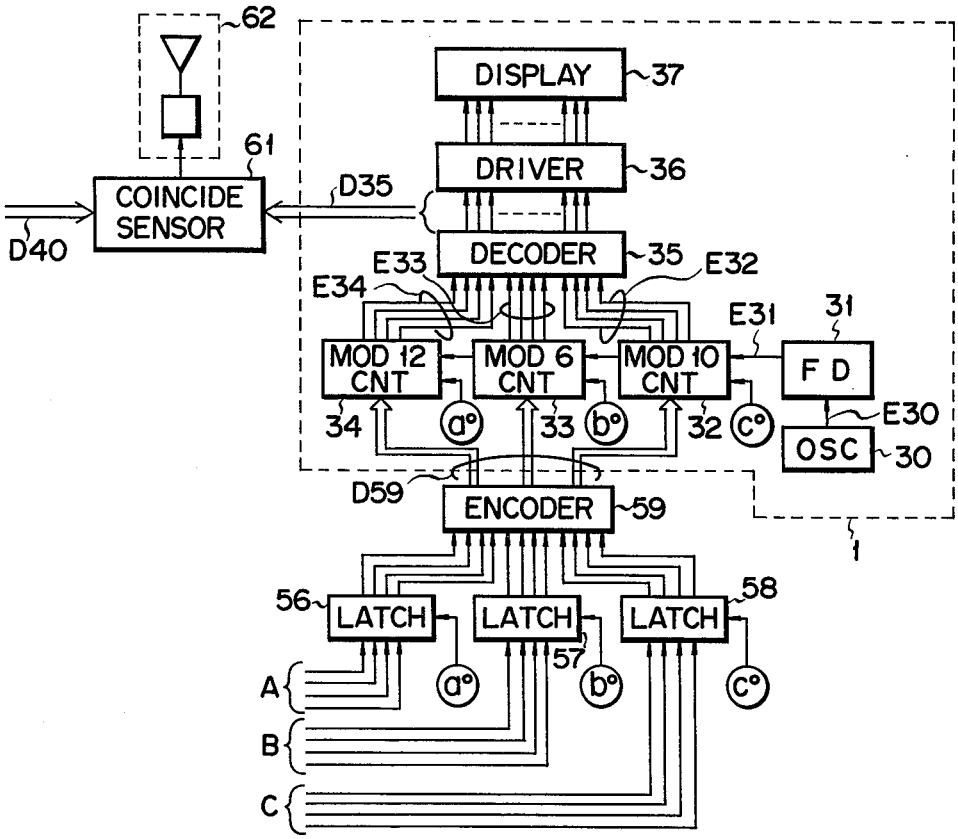
Figure 3B:
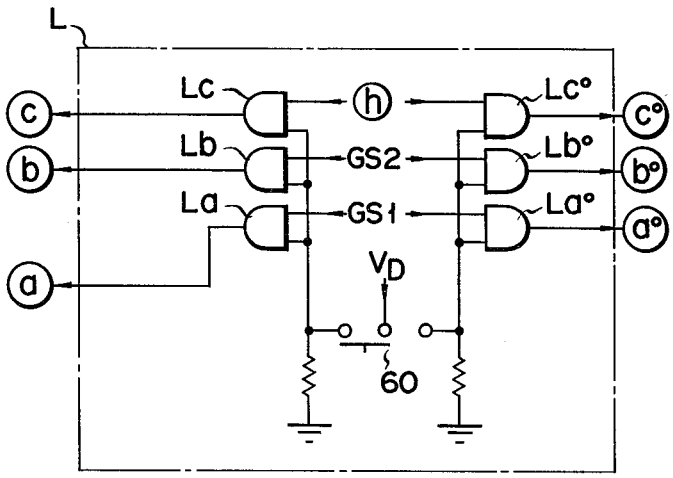

FIGS. 3A and 3B show a circuit configuration of the time set apparatus of the invention. How the alarm time is set will be explained with reference to these figures.

In FIG. 3B an output E30 of a reference frequency oscillator 30 is frequency-divided through a frequency divider 31 and changed to a minute clock pulse E31. Pulse E31 is further frequency-divided through a modulo 10 counter 32, a modulo 6 counter 33 and a modulo 12 counter 34. Counters 32–34 are all persettable type. Counters 32–34 generate one-minute-order signal E32, ten minute-order signal E33 and one hour-order signal E34, respectively. Signals E32–E34 are converted into actual time data D35 via a decoder 35. Data D35 is applied via a driver 36 to a digital display device 37 such as an LED array, a fluorescent display or a liquid crystal display. Device 37 displays the actual time according to data D35.

The components 30–37 constitute an electronic clock circuit 1.

A time set operation is carried out by hour set key array 11 and minute set key array 12 shown in FIG. 3A.

Hour set switches h1–h12 of array 11 are coupled to an hour encoder 38. Encoder 38 converts the key manipulation of each of switches h1–h12 into four-bit hour data D38 of binary code (BCD code). Encoder 38 also outputs a gate set signal GS1 which is generated every time when one of switches h1–h12 is turned on. Signal GS1 is applied to a latch control signal generation circuit L which will be mentioned later.

The binary-coded data D38 is applied to a first latch 39 via one branch of data lines A. Latch 39 stores data D38 corresponding to a specific hour when a latch control signal (a) is supplied from the circuit L to latch 39, and latch 39 provides a decoder 40 with latched hour data D39 of binary code. Decoded hour data corresponding to data D39 is applied via a driver 41 to a display device 42, and the hour part of set time for alarm etc. is displayed at device 42. Device 42 may be formed of an LED array, a fluorescent display, a liquid crystal display, etc.

Minute set switches m0–m55 of array 12 are coupled to a minute encoder 43. Encoder 43 converts the key manipulation of each of switches m0–m55 into four-bit minute data D43 of binary code (BCD code). Encoder 43 also outputs a gate set signal GS2 which is generated every time when one of switches m0–m55 is turned on.

The four-bit binary-coded data D43 corresponds to the key manipulation of twelve switches m0–m55, and each bit of data D43 is applied to each of data lines (d), (e), (f) and (g). Ten-minute unit data are applied to the three lines (e), (f), (g) of upper digit of data D43. Thus, the data on lines (e), (f), (g) indicates that the minute part of set time is less than 10 minutes, or exceeds 10 minutes mark, 20 minutes mark, 30 minutes mark, 40 minutes mark or 50 minutes mark.

The BCD coded data on these lines (e), (f), (g) is converted through a decoder 45 into data D45 which corresponds to any one of 0, 10, 20, . . . 40 or 50 minutes. Decoder 45 is formed of inverters and AND gates, and has a logical relation as shown in the below truth table I.

TABLE I

| | input data | | | output data (D45) | | | | | |
|---|---|---|---|---|---|---|---|---|---|
| MIN | e | f | g | 1 | 2 | 3 | 4 | 5 | 6 |
| 00 | 0 | 0 | 0 | 1 | 0 | 0 | 0 | 0 | 0 |
| 10 | 0 | 0 | 1 | 0 | 1 | 0 | 0 | 0 | 0 |
| 20 | 0 | 1 | 0 | 0 | 0 | 1 | 0 | 0 | 0 |
| 30 | 0 | 1 | 1 | 0 | 0 | 0 | 1 | 0 | 0 |
| 40 | 1 | 0 | 0 | 0 | 0 | 0 | 0 | 1 | 0 |
| 50 | 1 | 0 | 1 | 0 | 0 | 0 | 0 | 0 | 1 |

Data D45 corresponding to one of 0 to 50 minutes is converted by a modulo 6 encoder 46 into minute data D46. The encoded data D46 is applied to a second latch 47 via one branch of data lines B. The latching operation of latch 47 is controlled by a latch control signal (b) outputted from the circuit L. The latched data D46 of latch 47 is applied via decoder 40 and driver 41 to display device 42 and it is displayed in the same manner as said hour display.

The part of output data D43 on line (d) indicates 0 or 5 minutes. Thus, when the line (d) has logical "0" level it indicates 0 minute, and when the line (d) has logical "1" level it indicates 5 minutes. The data on line (d) is applied to a third latch 48. Latch 48 stores either 0-minute-related data or 5-minute-related data when the signal GS2 is supplied from encoder 43 to latch 48. The truth table II below shows the operation of latch 48.

TABLE II

| | | latched data | | | |
|---|---|---|---|---|---|
| MIN | d | I4 | I3 | I2 | I1 |
| 00 | 0 | 0 | 0 | 0 | 0 |
| 05 | 1 | 0 | 1 | 0 | 1 |

TABLE II-continued

| MIN | d | latched data I4 | I3 | I2 | I1 |
|---|---|---|---|---|---|
| 10 | 0 | 0 | 0 | 0 | 0 |
| 15 | 1 | 0 | 1 | 0 | 1 |
| 20 | 0 | 0 | 0 | 0 | 0 |
| 25 | 1 | 0 | 1 | 0 | 1 |
| 30 | 0 | 0 | 0 | 0 | 0 |
| 35 | 1 | 0 | 1 | 0 | 1 |
| 40 | 0 | 0 | 0 | 0 | 0 |
| 45 | 1 | 0 | 1 | 0 | 1 |
| 50 | 0 | 0 | 0 | 0 | 0 |
| 55 | 1 | 0 | 1 | 0 | 1 |

The latched data D48 of latch 48 is applied to an adder 49. When the time set data designated by key array 12 contains a fragment of 5 minutes, data D48 passes through adder 49 and becomes interpolation data D49 (at this time the interpolation value is "0"). This data D49 is applied to a fourth latch 50 via one branch of data lines C. Latch 50 stores data D49 when a latch control signal (c) is supplied from the circuit L to latch 50. Then the latched data D50 of latch 50 is applied via decoder 40 and driver 41 to display device 42. Device 42 displays at its lowest digit the "0" (0 minute) or the "5" (5 minutes) according to data D50.

The components 39–42, 47 and 50 constitute a set time display circuit 2.

When the time data to be set contains a fragment being larger than "0" minute and smaller than "5" minutes, one key of the minute switches m0–m55 which is most close to and less than the target minute value is once depressed. Then, the same key is subsequently depressed until the target minutes is obtained. For instance, when the target is 38 minutes, the key of switch m35 is once depressed and then the same key is further depressed by three times.

When above key manipulation is performed, encoder 43 outputs on lines (d)–(g) the BCD-coded data corresponding to "35". Encoder 43 generates the gate set signal GS2 every time when one key of switches m0–m55 is depressed. Signal GS2 and all signals on lines (d)–(g) are converted into a count pulse E51 through a pulser circuit 51.

Signal GS2 and date D43 on lines (d)–(g) are applied to a five-input type OR gate 511. An output E511 of gate 511 sets on RS flip-flop 512. A Q output E512 of flip-flop 512 is applied via a differentiation circuit 513 to one input of an AND gate 514. Output E512 is also applied via an inverter 515 and a differentiation circuit 516 to one input of an AND gate 517. The other input of each of gates 514 and 517 receives a power supply potential $V_D$ corresponding to logic "1" level. A gated output (count pulse) E51 of gates 514 and 517 is applied to the count input CK of an UP counter 52.

The output E511 is applied via a differentiator 531 to the count input CK of a modulo 5 counter 53 which is cleared by signal GS1. The carry out E53 of counter 53 is applied to one input of an OR gate 532 which receives at the other input the signal GS1. The output of gate 532 is differentiated by a differentiator 533 and changed to a clear pulse E54. Elements 53 and 531–533 form a clear pulse generation circuit 54. Flip-flop 512 and UP counter 52 are both cleared by pulse E54. Since pulse E54 is generated every five pulses of output E511, when one key of minute switches m0–m55 is depressed by more than five, the counted result D52 of counter 52 returns from "4" to "0". For instance, when one key of minute switches m0–m55 is depressed by six times, the count result of counter 52 is changed as:

$$0 \rightarrow 1 \rightarrow 2 \rightarrow 3 \rightarrow 4 \rightarrow 0 \rightarrow 1$$

Such count return saves erroneous manipulation of users.

The counted result D52 (0, 1, 2, . . . 4) of counter 52 is applied to a fifth latch 55 which stores the result D52 upon receipt of the set signal GS2. The latched data D55 corresponding to result D52 is applied to adder 49. Adder 49 adds the latched data D48 to the latched data D55 in binary form and supplies latch 50 with the added binary data through lines C. That is, data D49 on lines C contains the least significant digit data of time, or one minute data.

Latch 50 provides decoder 40 with binary data D50 having one-minute resolution in accordance with the control signal (c) of aforementioned circuit L. Then, alarm time data D40 of decoder 40 is applied via driver 41 to device 42 and device 42 displays the numeral of data D50.

Namely, when a key of hour set switches h1–h12 and a key of minute set switches m0–m55 are manipulated, the specific time data corresponding to these key manipulations is divided into one-hour data, ten-minute data and one-minute data. These data are applied to latches 39, 47 and 50 via lines A, B and C, respectively, and the latched data D39, D47 and D50 are applied via decoder 40 and driver 41 to device 42. Then, device 42 displays the specific time designated by the above key manipulations.

The other branches of lines A, B and C are applied to sixth latch 56, seventh latch 57 and eighth latch 58, respectively (FIG. 3B). Latches 56, 57 and 58 temporarily store binary time data of one-hour unit, ten-minute unit and one-minute unit upon receipt of latch control signals (a°), (b°) and (c°). The stored data in latches 56–58 are inputted to an encoder 59. Encoder 59 converts the input data into time data D59 in BCD form which are formed of hour data, ten-minute data and one-minute data. These three data are respectively loaded as present data into counters 34, 33 and 32 by the signals (a°), (b°) and (c°).

Counters 32–34 and latches 56–58 are controlled by signals (a°), (b°) and (c°) of latch control signal generation circuit L. In the circuit L, when a mode switch 60 designates the actual time correction (right side contace of switch 60), AND gated La°, Lb° and Lc° are opened. Then, signals GS1 and GS2 pass through gates La° and Lb°, and they come to be signals (a°) and (b°). Further, the output (h) of gates 514 and 517 (FIG. 3A) passes through gate Lc° and it comes to be a signal (c°). Signals (a°), (b°) and (c°) cause the latches 56, 57 and 58 to latch the set time, and the latched set time data is once preset into counters 32, 33 and 34. Incidentally, after these presetting, each of counters 32–34 continues to count the inputted clock pulse.

When mode switch 60 designates the alarm time set (left side contact of switch 60), AND gates La, Lb and Lc are opened, and signals (a), (b) and (c) corresponding respectively to signals GS1, GS2 and (h) are outputted. According to these signals (a), (b) and (c) the alarm set time displayed at device 42 is changed or corrected.

The actual time data D35 from decoder 35 and the alarm time data D40 from decoder 40 are inputtted to a coincidence sensor 61. Sensor 61 supplies an alarming circuit 62 with an alarm signal when data D35 coincides with data D40, so that a loud alarm sound is generated.

As mentioned above, when the alarm set time correction is designated by mode switch 60, latches 39, 47 and 50 of the set time display circuit 2 are actuated. When hour data from key array 11 is applied to device 42 via elements 38–41, the designated "hour portion" is displayed at device 42. When "ten-minute portion" of minute data from key array 12 is applied to device 42 via elements 43–47 and 40–41, the designated "ten-minute portion" is also displayed at device 42. Further, "one-minute portion" of minute data from key array 12 is applied to device 42 via elements 43, 48–50 and 40–41.

The logical level of line (d) from encoder 43 enables to discriminate the group of 0, 10, 20, . . . 50 minutes from the group of 5, 15, 25, . . . 55 minutes. Latch 48 stores data of "0-minute" or "5-minute" according to the line (d) level. The gate set signal GS2 from encoder 43 which is generated by every key manipulation of array 12 is applied to the wave-shaping circuit 51 and the wave-shaped pulse E51 is counted by counter 52. The counted result is stored in latch 55. The latched data D48 and D55 are added in adder 49, and adder 49 provides the latch 50 with the added result D49. Device 42 displays "one-minute portion" of time according to the data obtained via elements 41 and 40 from latch 50.

When the present actual time correction is designated by mode switch 60, three data on lines A, B and C are applied via latches 56, 57 and 58 to encoder 59. Three encoded data obtained from encoder 59 are applied respectively to counter 32, 33 and 34 as the preset data. The actual time data corrected by this preset operation is applied via elements 35 and 36 to device 37, and device 37 diaplays the corrected actual time.

Further, when the contents of data D35 from decoder 35 coincide with the contents of data D40 from decoder 40, an alarm sound is generated.

Thus, according to the abovementioned circuitry, it is possible to obtain an electronic clock having an alarm function whose time set resolution is one minute and the one-minute time set manipulation is performed only by one of twelve keys of minute switches m0–m55.

Figure 4A:
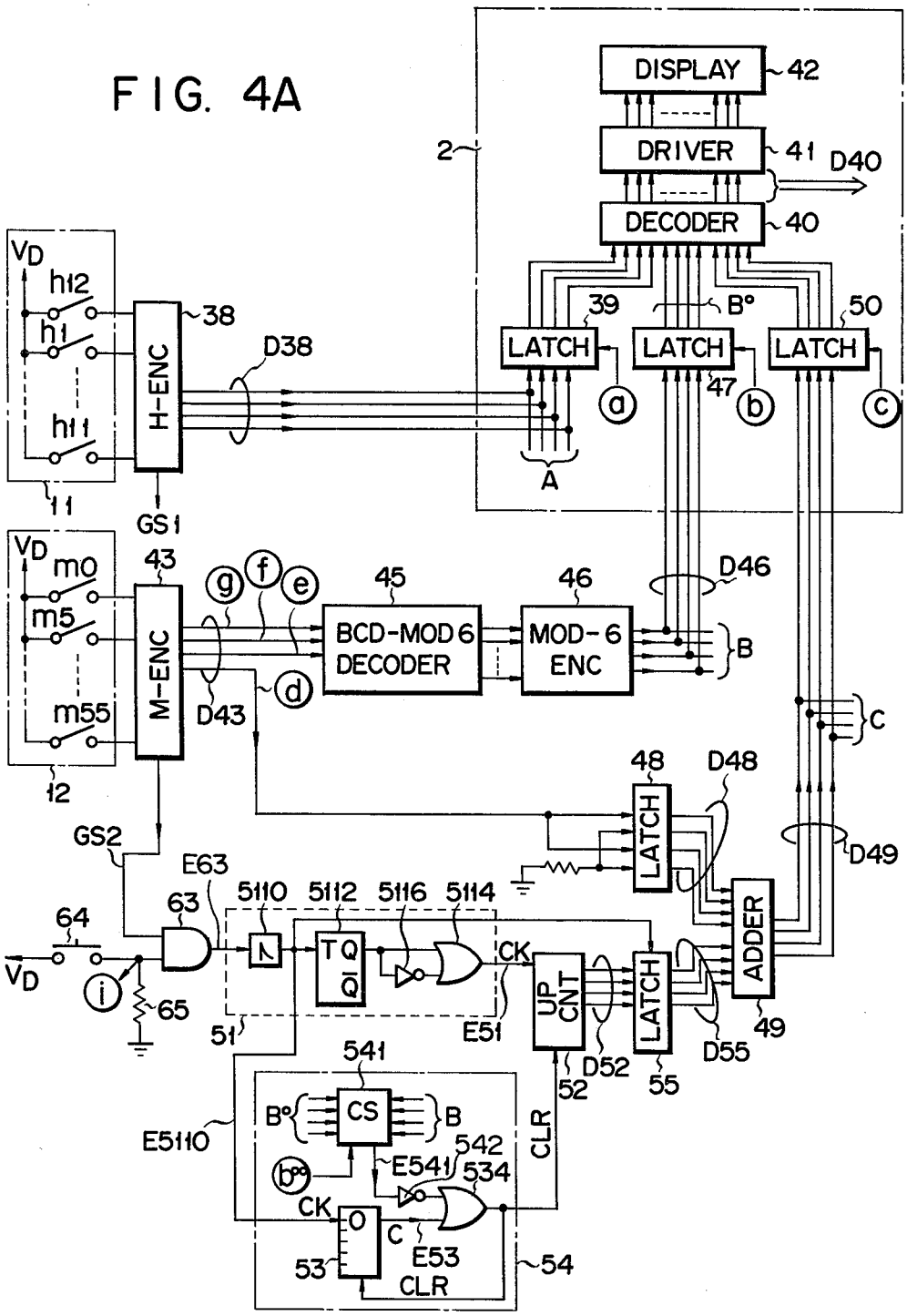
FIGS. 4A and 4B jointly show another embodiment of the invention.
Figure 4B:
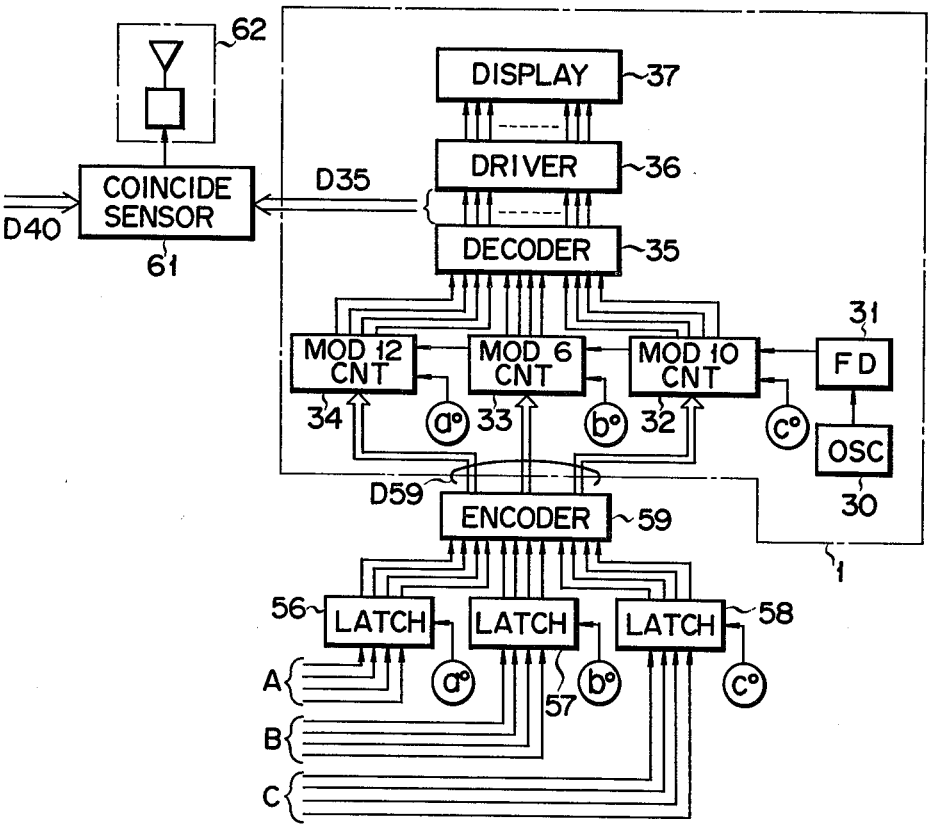
Figure 4B:
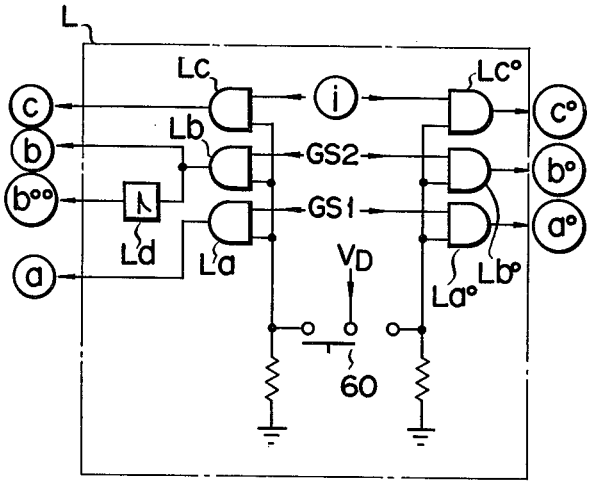

FIGS. 4A and 4B show (alternative) embodiment of the invention. The description will be given only to the specific parts that are different from the configuration of FIGS. 3A and 3B.

In the embodiment of FIGS. 4A and 4B the gate set signal GS2 from encoder 43 is applied to a pulser circuit 51 via one input of an AND gate 63. The other input of gate 63 is coupled via a count inhibition switch 64 to the positive power source $V_D$, and is also grounded via a resistor 65. Gate 63 is closed when switch 64 is OFF so that signal GS2 is not transmitted to circuit 51. An output E63 of gate 63 is differentiated by circuit 51 and converted into the count pulse E51.

When the key of switch 64 is not depressed (OFF), signal GS2 from encoder 43 cannot pass through gate 63 so that no clock pulse is applied to up counter 52 via pulser circuit 51. In this case, the contents of data D55 applied to adder 49 are always "0". Namely, even if the key of 35-minute switch m35 is erroneously depressed by more than one time and the user really intends to set "35 minutes" for example, the set time of the minute portion is "35" regardless of more than one time of key manipulations of switch m35, unless the switch 64 is ON. On the other hand, if the user intends to set "38 minutes", after the set of "35 minutes", he may push the key of switch m35 by three times while depressing the key of switch 64. At this time the display of minute portion changes with every key manipulation of switch m35 as:

35→36→37→38

Thus, the combination of elements 63–65 prevents a mistake of key manipulation of minute set switches m0–m55. In other words, OFF of switch 64 provides the time set resolution of "5 minutes" and ON of switch 64 provides the time set resolution of "1 minute".

The pulse circuit 51 and the clear pulse circuit 54 of FIG. 4A are somewhat different from that of FIG. 3A in their configurations. In FIG. 4A the output E63 of gate 63 is differentiated by a differentiator 5110. A differentiated pulse E5110 outputted from differentiator 5110 clocks a T-type flip-flop 5112 as well as modulo 5 counter 53, and triggers latch 55. The Q output of flip-flop 5112 is applied directly to one input of an OR gate 5114 and to the other input of gate 5114 through an delayed inverter 5116. The combination of gate 5114 and inverter 5116 forms a logic differentiator. Gate 5114 generates a differentiated pulse E51 whose pulse width corresponds to the delayed time of inverter 5116.

The carry out E53 of counter 53 is applied to one input of an OR gate 534. The other input of gate 534 receives via an inverter 542 a coincidence pulse E541 obtained from a coincidence sensor 541. Sensor 541 compares data B with data B° and generates the pulse E541 upon receipt of an enabling pulse b°° when data B coincides with data B°. Thus, the output level of inverter 542 is logical "0" when B=B°, and it is logical "1", when B≠B°. The condition B≠B° could occur at the time of carry-completion or at the time of power-ON. Here, data B° is a latched data of latch 47. The pulse b°° is generated when switch 60 selects the left side contact and signal GS2 is inputted to AND gate Lb. Thus, gate Lb outputs signal (b), and this signal (b) is differentiated by a differentiator Ld and converted into the pulse b°°.

Incidentally, the counter 53 may be modulo 10, modulo 15, moldulo 30, or any other modulos (modulo 60 or less) counter.

Figure 5:
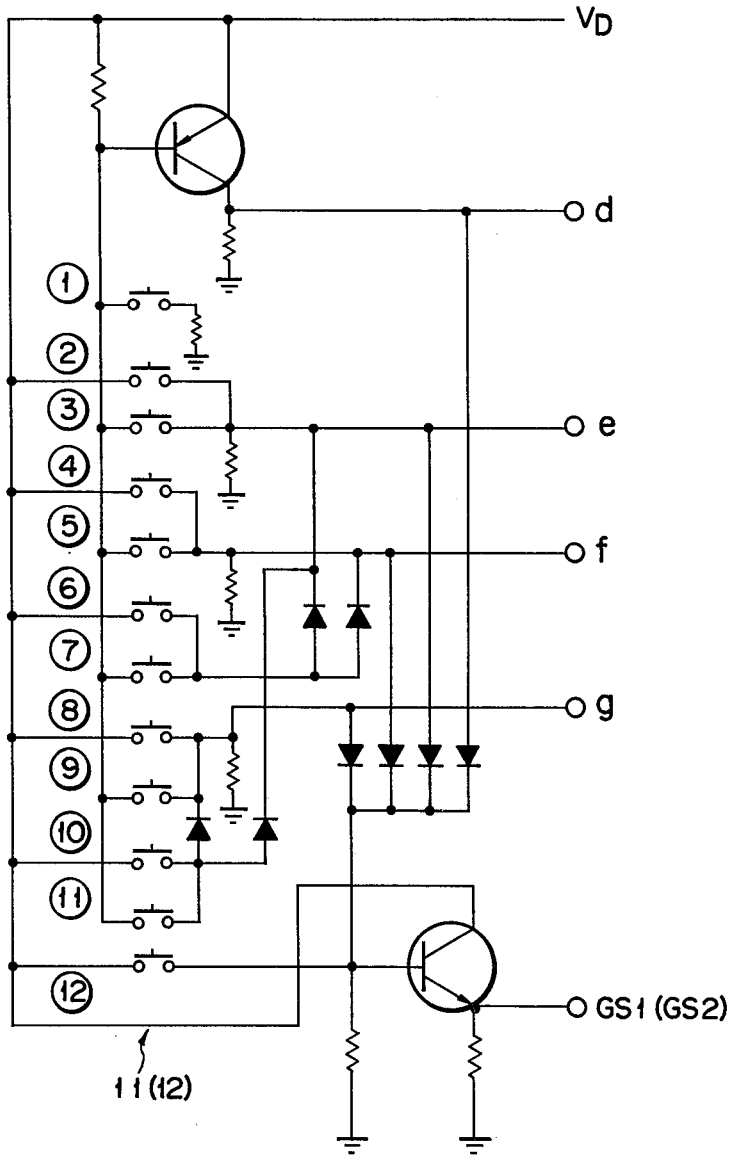
FIG. 5 illustrates a circuit configuration of a key array (11 or 12) and an encoder (38 or 43) shown in FIG. 3A or 4A.

FIG. 5 shows a circuit of key array 11 or 12. In FIG. 5 each of key-switches (1) to (12) is encoded to 4-bit BCD code. The truth table of FIG. 5 encoder is as follows.

TABLE III

| Key No. | BCD code g | f | e | d |
|---|---|---|---|---|
| 12 | 0 | 0 | 0 | 0 |
| 1 | 0 | 0 | 0 | 1 |
| 2 | 0 | 0 | 1 | 0 |
| 3 | 0 | 0 | 1 | 1 |
| 4 | 0 | 1 | 0 | 0 |
| 5 | 0 | 1 | 0 | 1 |
| 6 | 0 | 1 | 1 | 0 |
| 7 | 0 | 1 | 1 | 1 |
| 8 | 1 | 0 | 0 | 0 |
| 9 | 1 | 0 | 0 | 1 |
| 10 | 1 | 0 | 1 | 0 |
| 11 | 1 | 0 | 1 | 1 |

Figure 6:
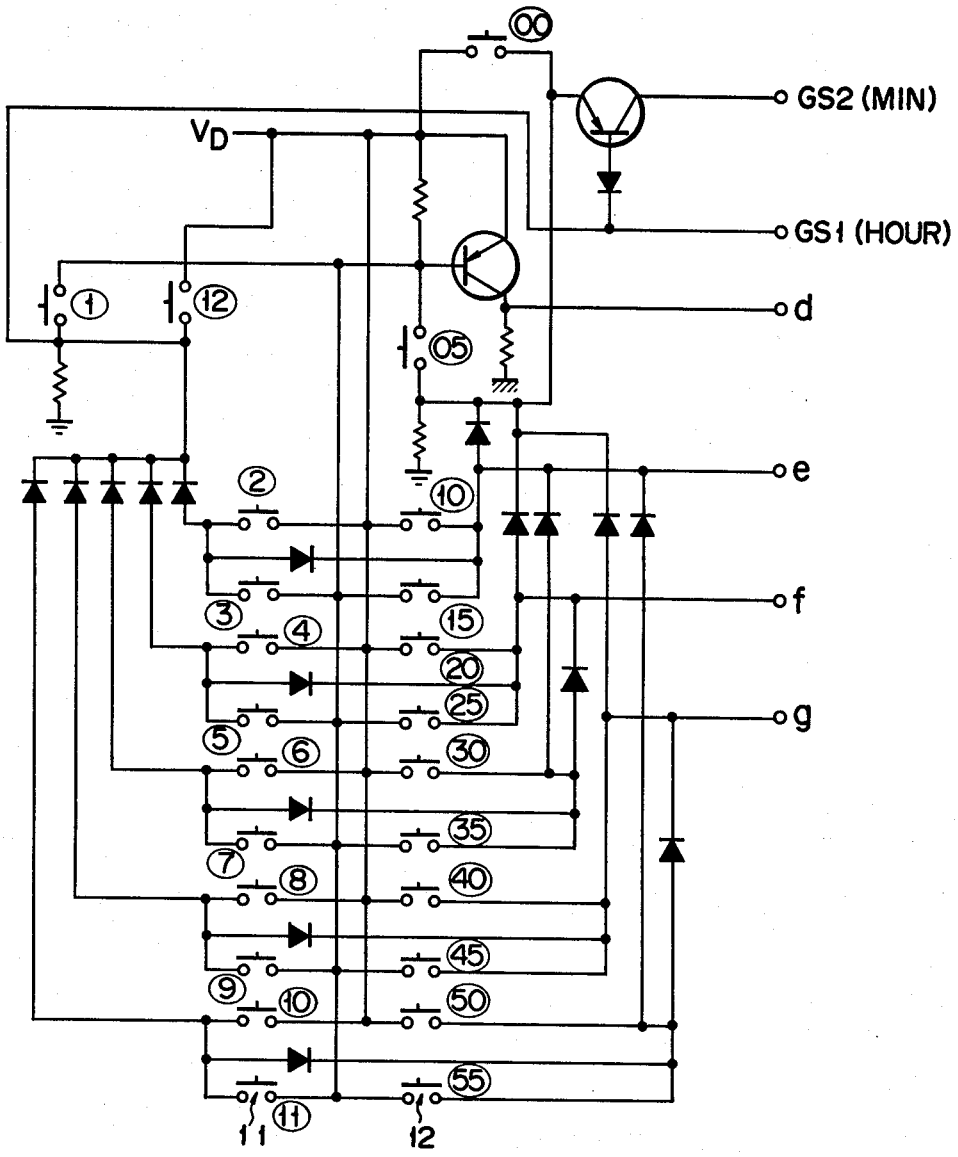
FIG. 6 illustrates a circuit configuration of key arrays (11 and 12) and encoders (38 and 43) shown in FIG. 3A or 4A.

FIG. 6 shows another circuit of key arrays 11 and 12.

Figure 7:
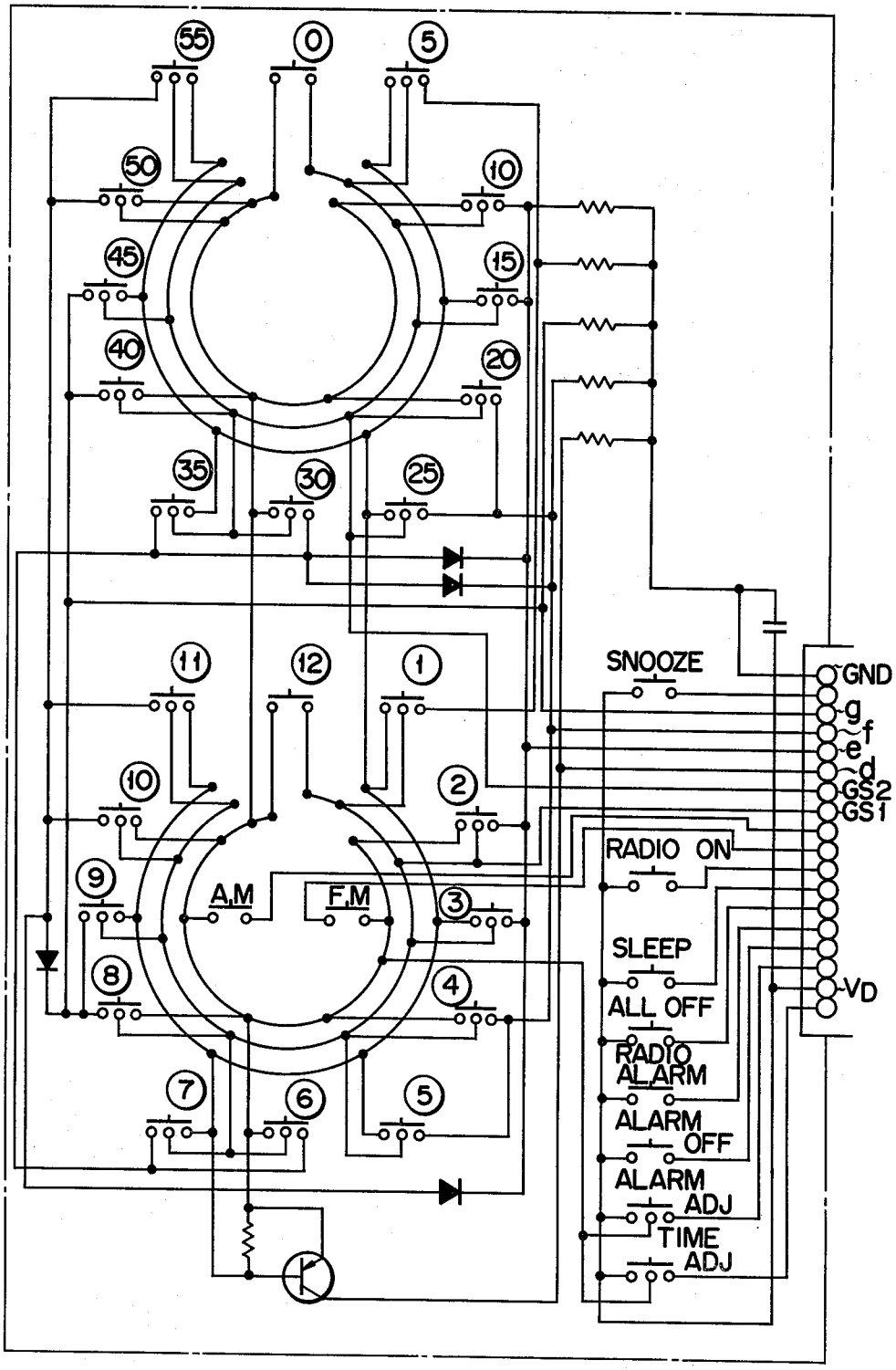
FIG. 7 illustrates another circuit configuration of key arrays (11 and 12) and encoders (38 and 43) shown in FIG. 3A or 4A.

FIG. 7 shows another circuit configuration of key arrays 11 and 12 containing encoders 38 and 43. FIG. 7 configuration is the best mode of the elements 11, 12, 38 and 43 at this time. This configuration is used in the actual manufactures:

Model RC-K1 AM/FM 2-BAND CLOCK RADIO manufactured by TOSHIBA, Co., Japan

Figure 8:
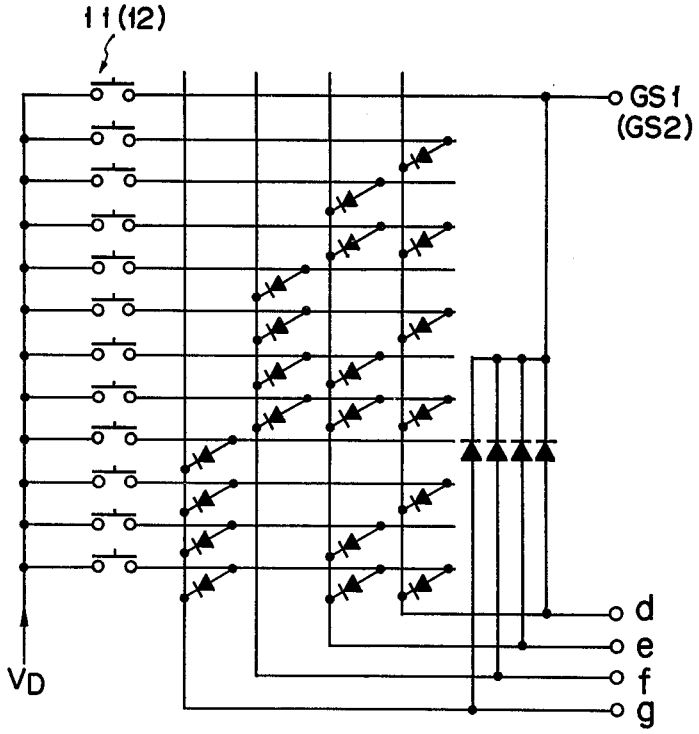
FIG. 8 illustrates another circuit configuration of a key array (11 or 12) and an encoder (38 or 43) shown in FIG. 3A or 4A.

FIG. 8 shows another circuit of encoder 38 or 43 in which a diode matrix is used.

Figure 9:
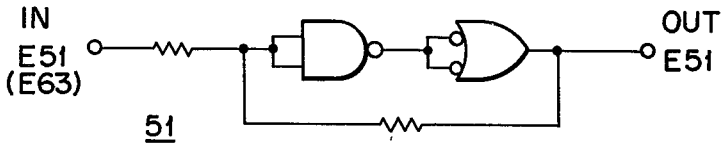
FIG. 9 shows a modification of a pulser circuit (51) shown in FIG. 3A or 4A.

FIG. 9 shows a modification of pulser circuit 51. In FIG. 9 the circuit 51 is formed of a Schmitt trigger circuit.

Figure 10:
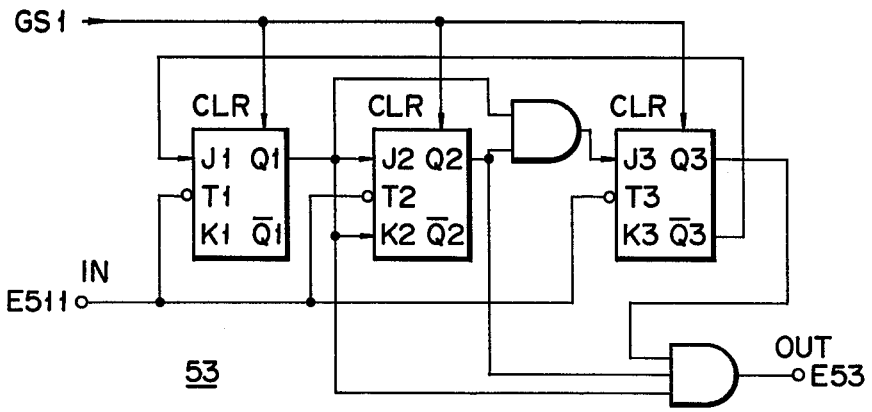
FIG. 10 shows a circuit configuration of a modulo 5 counter (53) shown in FIG. 3A or 4A.

FIG. 10 shows one embodiment of modulo 5 counter 53.

Figure 11:
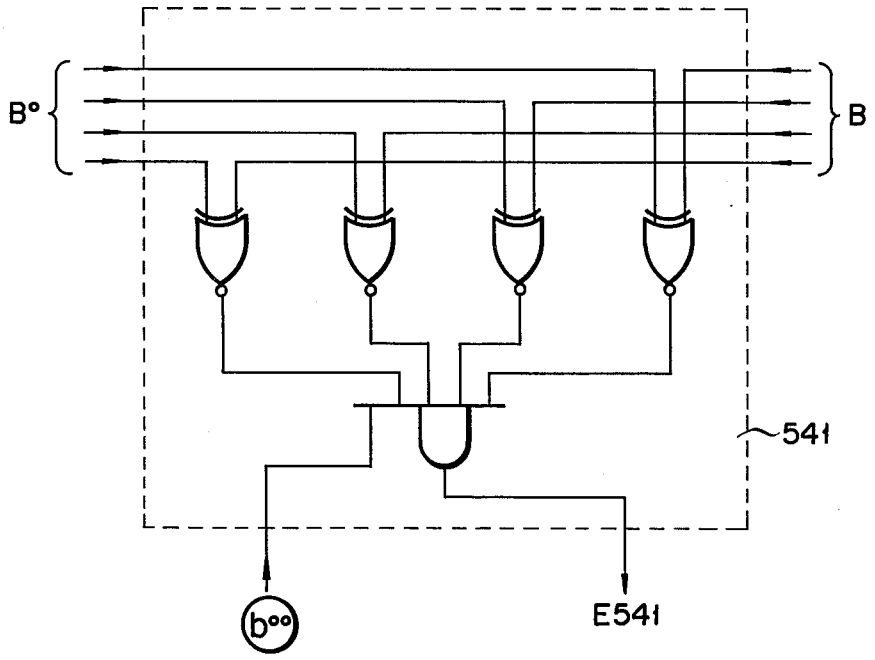
FIG. 11 shows a circuit configuration of a coincide sensor (541) shown in FIG. 4A.

FIG. 11 shows a circuit configuration of coincidence sensor 541. In FIG. 11, each bit of data B is compared with corresponding bit of data B° of an EXNOR gate, and all of EXNORed outputs are applied to an AND gate. The AND gate outputs the coincidence pulse E541 upon receipt of the pulse b°° when all the EXNORed outputs from logical "1" level.

Figure 12:
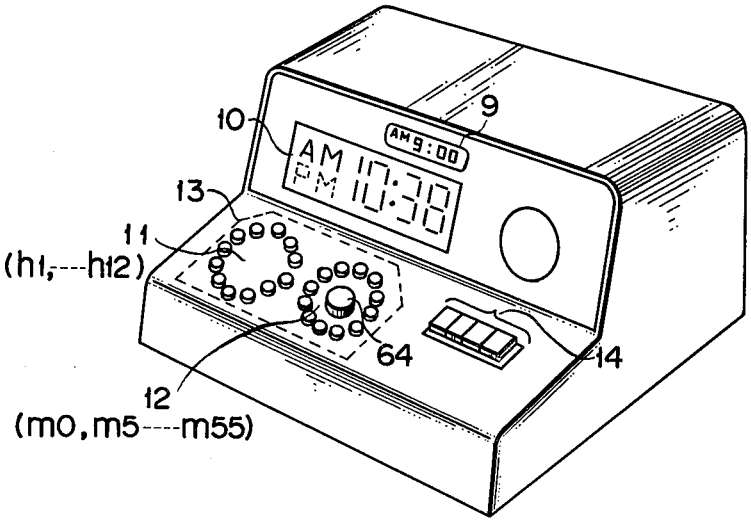
FIG. 12 shows a modification of FIG. 2.

FIG. 12 is a modification of FIG. 2. FIG. 12 shows that the key of count inhibition switch 64 (FIG. 4A) is arranged at the center position of the circularly laidout minute set key array 12.

Figure 13:
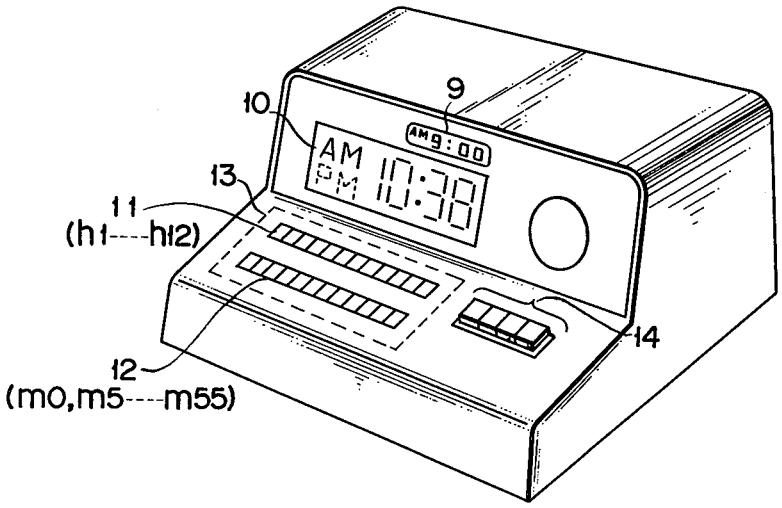
FIG. 13 shows another modification of FIG. 2.

FIG. 13 is another modification of FIG. 2. In FIG. 13 the key-layout of each arrays 11 and 12 is linear.

Figure 14:
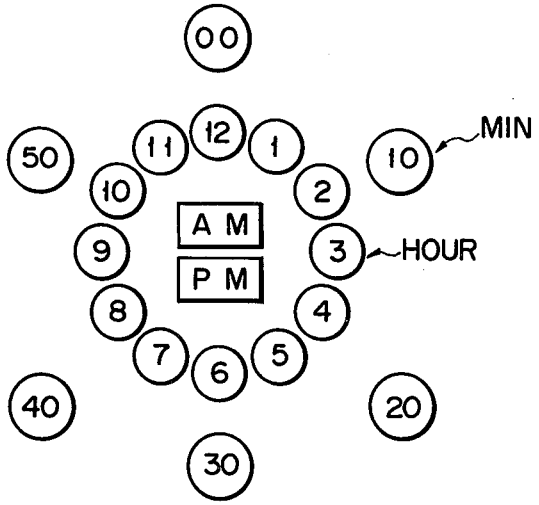
FIG. 14 shows a key layout of hour key array (11) and minute key array (12)

FIG. 14 shows another key layout of arrays 11 and 12. In FIG. 14 the circular key array of hour switches h1–h12 encircles two mode selection keys for AM/PM, and keys of minute switches m0–m55 are coaxially arranged around the hour key array.

Figure 15:
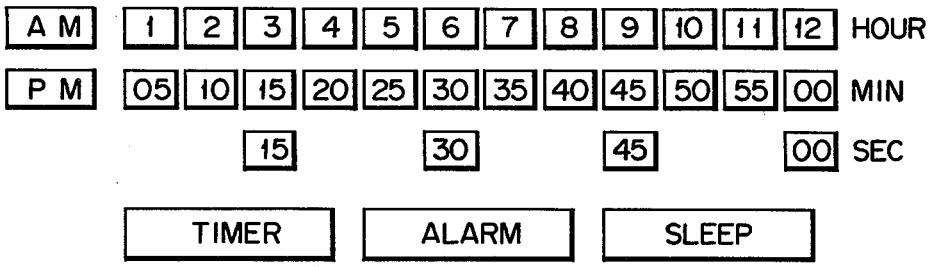
FIG. 15 shows a modification of FIG. 14.

FIG. 15 is a modification of FIG. 14. In FIG. 15 the key-layout of each of key arrays 11 and 12 is linear, and second set keys are further provided. Of course, the interpolation circuit of minute time set may be applied to the second time set.

The alarming circuit 62 of FIG. 3B or 4B may be radio receivers, audio components, VTR, TV or any other electrical instruments.

Incidentally, a digital multiplier may be inserted between up counter 52 and latch 55. When ×2 multiplier is used here, the contents of data D52 is changed by every two minutes. In this case, the resolution of time set is two minutes.

What is claimed is:

1. A time set apparatus for an electronic clock comprising:

hour switch means for generating twelve kinds of hour data minute switch means for generating plural kinds of minute data;

time set and display means, coupled to said hour switch means and to said minute switch means for displaying a time determined by said hour and minute data resulting from manipulation of said hour and minute switch means;

interpolation means, coupled to said minute switch means and to said time set and display means for interpolating a time-set interval between one kind of said minute data and another kind thereof which is adjacent to said one kind of minute data, and for generating interpolation data indicating how many times said minute data is generated, the time displayed by said display means being modified according to said interpolation data so that an interpolated minute display is performed.

2. The apparatus of claim 1, further comprising:

time correction means coupled to said hour switch means, minute switch means and interpolation means for generating correction data;

correction enable means for generating an enable signal; and an electronic clock circuit having a present time display, coupled to said time correction means and to said correction enable means, wherein the present time display of said electronic clock circuit is changed according to said correction data when said enable signal is generated.

3. The apparatus of claim 2, further comprising:

alarm means coupled to said time set and display means and to said clock circuit for generating an alarm when the time displayed at said time set and display means coincides with time displayed by said present time display of said electronic clock circuit.

4. The apparatus of claim 2, further comprising:

actuator means coupled to an electronic device which is adapted to the electronic clock, and coupled to said display means and clock circuit, for actuating said electronic device when the time displayed at said time set and display means coincides with time displayed by said present time display of said electronic clock circuit.

5. The apparatus of claim 1 wherein said hour switch means includes twelve hour switches each corresponding to one of 1 o'clock to 12 o'clock.

6. The apparatus of claim 2 wherein said hour switch mans includes twelve hour switches each corresponding to one of 1 o'clock to 12 o'clock.

7. The apparatus of claim 3 wherein said hour switch means includes twelve hour switches each corresponding to one of 1 o'clock to 12 o'clock.

8. The apparatus of claim 4 wherein said hour switch means includes twelve hour switches each corresponding to one of 1 o'clock to 12 o'clock.

9. The apparatus of claim 5 wherein said minute switch means includes twelve minute switches each corresponding to one of 0, 5, 10, . . . 50 and 55 minutes.

10. The apparatus of claim 6 wherein said minute switch means includes twelve minute switches each corresponding to one of 0, 5, 10, . . . 50 and 55 minutes.

11. The apparatus of claim 7 wherein said minute switch means includes twelve minute switches each corresponding to one of 0, 5, 10, . . . 50 and 55 minutes.

12. The apparatus of claim 8 wherein said minute switch means includes twelve minute switches each corresponding to one of 0, 5, 10, . . . 50 and 55 minutes.

13. The apparatus of claim 5 wherein said minute switch means includes six minute switches each corresponding to one of 0, 10, 20, 30, 40 and 50 minutes.

14. The apparatus of claim 6 wherein said minute switch means includes six minute switches each corresponding to one of 0, 10, 20, 30, 40 and 50 minutes.

15. The apparatus of claim 7 wherein said minute switch means includes six minute switches each corresponding to one of 0, 10, 20, 30, 40 and 50 minutes.

16. The apparatus of claim 8 wherein said minute switch means includes six minute switches each corresponding to one of 0, 10, 20, 30, 40 and 50 minutes.

17. The apparatus of claim 9 wherein said minute switch means includes:

encoder means, coupled to said minute switches, for generating first minute data being changed by every ten minutes, for generating second minute data being changed by every five minutes, and for generating third minute data being changed by every manipulation of said minute switches;

ten-minute means, coupled to said encoder means, for generating said minute data according to said first minute data; and five-minute means coupled to said encoder means for generating five-minute data according to said second minute data, and wherein said interpolating means includes:

one minute means, coupled to said encoder means, for counting said third minute data and generating one-minute data indicating that how many times one of said minute switches is manipulated; and means, coupled to said five-minute means and to said one-minute means, for adding said one-minute data to said five-minute data in order to generate said interpolation data.

18. The apparatus of claim 10 wherein minute means includes:

encoder means, coupled to said minute switches, for generating first minute data being changed by every ten minute, for generating second minute data being changed by every five minutes, and for generating third minute data being changed by every manipulation of said minute switches;

ten-minute means, coupled to said encloder means, for generating said minute data according to said first minute data; and five-minute means, coupled to said encoder means, for generating five-minute data according to said second minute data, and wherein said interpolating means includes:

one minute means, coupled to said encoder means, for counting said third minute data and generating one-minute data indicating that how many times one of said minute switches is manipulated; and means, coupled to said five-minute means and to said one-minute means, for adding said one-minute data to said five-minute data in order to generate said interpolation data.

19. The apparatus of claim 11 wherein minute means includes:

encoder means, coupled to said minute switches, for generating first minute data being changed by every ten minutes, for generating second minute data being changed byevery five minutes, and for generating third minute data being changed by every manipulation of said minute switches;

ten-minute means, coupled to said encoder means, for generating said minute data according to said first minute data; and five-minute means, coupled to said encoder means, for generating five-minute data according to said second minute date, and wherein said interpolating means includes:

one minute means, coupled to said encoder means, for counting said third minute data and generating one-minute data indicating that how many times one of said minute switches is manipulated; and means, coupled to said five-minute means and to said one-minute means, for adding said one-minute data to said five minute data in order to generate said interpolation data.

20. The apparatus of claim 12 wherein minute means includes:

encoder means, coupled to said minute switches, for generating first minute data being changed by every ten minutes, for generating second minute data being changed by every five minutes, and for generating third minute data being changed by every manipulation of said minute switches;

ten-minute means, coupled to said encoder means, for generating said minute data according to said first minute data; and five-minute mean, coupled to said encoder means, for generating five-minute data according to said second minute data, and wherein said interpolating means includes:

one minute means, coupled to said encoder means, for counting said third minute data and generating one-minute data indicating that how many times one of said minute switches is manipulated; and means, coupled to said five-minute means and to said one-minute means, for adding said one-minute data to said five minute data in order to generate said interpolation data.

21. The apparatus of claim 17 wherein said one-minute means includes:

counter means for counting how many times said third minute data are generated in order to provide count data indicating the interpolation value within five minutes; and means, coupled to said counter means, for storing said count data after completion of the counting, and for providing said one-minute data.

22. The apparatus of claim 18 wherein said one-minute means includes:

counter means for counting how many times said third minute data are generated in order to provide count data indicating the interpolation value within five minutes; and means, coupled to said counter means, for storing said count data after completion of the counting, and for providing said one-minute data.

23. The apparatus of claim 19 wherein said one-minute means includes:

counter means for counting how many times said third minute data are generated in order to provide count data indicating the interpolation value within five minutes; and means, coupled to said counter means, for storing said count data after completion of the counting, and for providing said one-minute data.

24. The apparatus of claim 20 wherein said one-minute means includes:

counter means for counting how many times said third minute data are generated in order to provide count data indicating the interpolation value within five minutes; and means, coupled to said counter means, for storing said count data after completion of the counting, and for providing said one-minute data.

25. The apparatus of claim 21 wherein said one-minute means further includes:

clear means, coupled to said counter means, for clearing the counted result thereof when said counter means completes five times count.

26. The apparatus of claim 22 wherein said one-minute means further includes:

clear means, coupled to said counter means, for clearing the counted result thereof when said counter means completes five times count.

27. The apparatus of claim 22 wherein said one-minute means further includes:

clear means, coupled to said counter means, for clearing the counted result thereof when said counter means completes five times count.

28. The apparatus of claim 24 wherein said one-minute means further includes:

clear means, coupled to said counter means, for clearing the counted result thereof when said counter means completes five times count.

29. The apparatus of claim 17 wherein interpolation means further includes:

means, coupled to said encoder means and one-minute means, for inhibiting the count in said one-minute means when the interpolation of said five-minute data should not be carried out.

30. The apparatus of claim 21 wherein interpolation means further includes:

means, coupled to said encoder means and one-minute means, for inhibiting the count in said one-minute means when the interpolation of said five-minute data should not be carried out.

31. The apparatus of claim 25 wherein interpolation means further includes:

means, coupled to said encoder means and one-minute means, for inhibiting the count in said one-minute means when the interpolation of said five-minute data should not be carried out.

* * * * *